US009284923B2

(12) United States Patent
Kimoto et al.

(10) Patent No.: US 9,284,923 B2
(45) Date of Patent: Mar. 15, 2016

(54) FUEL VAPOR RECOVERY APPARATUS

(71) Applicant: AISAN KOGYO KABUSHIKI KAISHA, Obu-shi, Aichi-ken (JP)

(72) Inventors: Junya Kimoto, Obu (JP); Shinji Murai, Aichi-ken (JP); Sunao Kitamura, Nagoya (JP)

(73) Assignee: AISAN KOGYO KABUSHIKI KAISHA, Obu-Shi, Aichi-Ken (JP)

( * ) Notice: Subject to any disclaimer, the term of this patent is extended or adjusted under 35 U.S.C. 154(b) by 230 days.

(21) Appl. No.: 14/050,111

(22) Filed: Oct. 9, 2013

(65) Prior Publication Data

US 2014/0102420 A1 Apr. 17, 2014

(30) Foreign Application Priority Data

Oct. 12, 2012 (JP) ..... 2012-226870

(51) Int. Cl.
*F02M 25/08* (2006.01)

(52) U.S. Cl.
CPC ... *F02M 25/0836* (2013.01); *F02M 2025/0845* (2013.01)

(58) Field of Classification Search
CPC ..... F02M 25/08; F02M 25/0809; F02M 25/0836; F02M 25/0854; F02M 25/0872; F02D 41/00; F02D 41/003; F16K 31/04
USPC ..... 123/516–521; 251/129.01, 129.11
See application file for complete search history.

(56) References Cited

U.S. PATENT DOCUMENTS 5,613,481 A * 3/1997 Kitagawa et al. ..... 123/698
5,623,911 A * 4/1997 Kiyomiya et al. ..... 123/520
5,915,364 A * 6/1999 Katou et al. ..... 123/519
6,047,687 A * 4/2000 Ishikawa et al. ..... 123/518
6,332,456 B2 * 12/2001 Mashiki ..... 123/520

(Continued)

FOREIGN PATENT DOCUMENTS

DE 19838959 A1 3/2000
DE 102010014558 A1 10/2011

(Continued)

OTHER PUBLICATIONS

German Patent Application No. 102013016984.4 Office Action dated Dec. 22, 2014 (7 pages).

(Continued)

*Primary Examiner* — John Kwon
*Assistant Examiner* — Johnny H Hoang
(74) *Attorney, Agent, or Firm* — Conley Rose, P.C.

(57) ABSTRACT

A fuel vapor recovery apparatus to be mounted on a vehicle having a fuel tank has an adsorbent canister capable of adsorbing and desorbing fuel vapor vaporized in the fuel tank, a vapor path providing communication between the fuel tank and the adsorbent canister, a purge path providing communication between the adsorbent canister and an intake path of an internal combustion engine, a purge valve configured to open and close the purge path, a blocking valve configured to open and close the vapor path and having a valve body, and a regulator for controlling the purge valve and the blocking valve. The fuel tank is sealed when the blocking valve is closed. The fuel tank is configured to be depressurized by opening the blocking valve. The blocking valve is composed of a motor valve that has a driving motor and can adjust an opening amount by controlling a stroke of the valve body.

7 Claims, 4 Drawing Sheets

(56) References Cited

U.S. PATENT DOCUMENTS

| | | | | |
|---|---|---|---|---|
| 7,594,500 | B2 * | 9/2009 | Rockwell et al. | 123/519 |
| 8,607,765 | B2 | 12/2013 | Hagen | |
| 2003/0226549 | A1 * | 12/2003 | Takagi et al. | 123/520 |
| 2007/0186915 | A1 * | 8/2007 | Annoura | 123/698 |
| 2008/0035868 | A1 * | 2/2008 | Okuda | 251/118 |
| 2010/0288242 | A1 * | 11/2010 | Makino et al. | 123/521 |
| 2011/0253110 | A1 * | 10/2011 | Fukui | 123/520 |
| 2011/0296997 | A1 | 12/2011 | Sugiura | |
| 2012/0085424 | A1 * | 4/2012 | Hagen | 137/14 |
| 2012/0130596 | A1 * | 5/2012 | Ooiwa | 701/45 |
| 2012/0211687 | A1 | 8/2012 | Benjey et al. | |

FOREIGN PATENT DOCUMENTS

| | | | |
|---|---|---|---|
| JO | 7-174049 | A | 7/1995 |
| JP | 2-238162 | A | 9/1990 |
| JP | 2-241963 | A | 9/1990 |
| JP | 08-004931 | | 1/1996 |
| JP | 08-049774 | | 2/1996 |
| JP | 9-287503 | A | 11/1997 |
| JP | 2005307919 | A | 11/2005 |
| JP | 2010-270652 | A | 12/2010 |
| JP | 2011144848 | A | 7/2011 |
| JP | 2011252586 | A | 12/2011 |
| JP | 2012-47068 | A | 3/2012 |
| WO | 2012-110889 | A1 | 8/2012 |

OTHER PUBLICATIONS

Japanese Patent Application No. 2012-226870 Notification of Reasons for Rejection dated Jan. 26, 2016 (8 pages).

* cited by examiner

FUEL VAPOR RECOVERY APPARATUS

This application claims priority to Japanese patent application serial number 2012-226870, the contents of which are incorporated herein by reference.

BACKGROUND OF THE INVENTION

The present disclosure relates to a fuel vapor recovery apparatus to be mounted on a vehicle such as automobile.

This kind of fuel vapor recovery apparatus has a sealed tank system that usually seals a fuel tank with a high inner pressure in order to suppress the release of fuel vapor from the fuel tank. The fuel vapor recovery apparatus then depressurizes the fuel tank at the appropriate time (see, for example, Japanese Laid-Open Patent Publication No. 2005-307919). Depressurizing in the sealed tank system is normally carried out while the engine is running and during purge operation for allowing the flow of fuel vapor from a canister to an air intake system.

In Japanese Laid-Open Patent Publication No. 2005-307919, a solenoid valve is used as a blocking valve opening and closing a vapor path for providing communication between the fuel tank and the canister. The solenoid valve has an electromagnetic solenoid such that it is closed when current is not applied and it is open when current is applied. The blocking valve of the sealed tank system is usually composed of a solenoid valve.

In Japanese Laid-Open Patent Publication No. 2005-307919, in the opening period, the depressurizing volume is controlled by duty control of the solenoid valve. However, when the solenoid valve is used for the blocking valve, movement stroke of a valve body becomes large in order to ensure a flow path for smooth refueling. Thus, since duty control of the solenoid valve having a large stroke is carried out, depressurizing is intermittent, and a large amount of fluid flows through every opening of the valve, so that influence on air-fuel (A/F) ratio is large. Therefore, there has been a need for an improved fuel vapor recovery apparatus.

BRIEF SUMMARY OF THE INVENTION

One aspect of this disclosure is a fuel vapor recovery apparatus to be mounted on a vehicle having a fuel tank, including an adsorbent canister capable of adsorbing and desorbing fuel vapor vaporized in the fuel tank, a vapor path for providing communication between the fuel tank and the adsorbent canister, a purge path for providing communication between the adsorbent canister and an intake path of an internal combustion engine, a purge valve configured to open and close the purge path, a blocking valve configured to open and close the vapor path and having a valve body, and a regulator for controlling the purge valve and the blocking valve. The fuel tank is sealed when the blocking valve is closed. The fuel tank is configured to be depressurized by opening the blocking valve. The blocking valve is composed of a motor valve that has a driving motor and can adjust an opening amount by controlling a stroke of the valve body.

In accordance with this aspect, the blocking valve is a motor valve that has a driving motor and can adjust an opening amount by controlling the stroke of the valve body, so that it is different from a solenoid valve, and a small amount of depressurizing during purge operation can be continuously carried out. Thus, any influence on the air-fuel ratio of the internal combustion engine can be decreased.

DETAILED DESCRIPTION OF THE INVENTION

Each of the additional features and teachings disclosed above and below may be utilized separately or in conjunction with other features and teachings to provide improved fuel vapor recovery apparatuses. Representative examples of the present invention, which examples utilized many of these additional features and teachings both separately and in conjunction with one another, will now be described in detail with reference to the attached drawings. This detailed description is merely intended to teach a person of skilled in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

Figure 1:
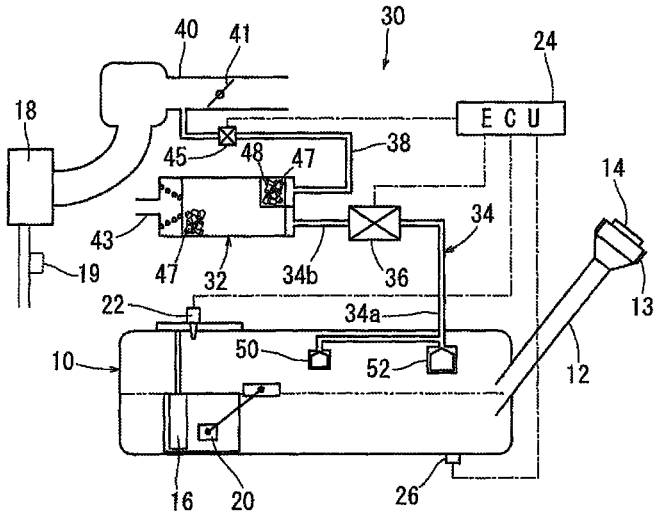
FIG. 1 is schematic view of a flow vapor recovery apparatus.

One embodiment will be described in reference to the drawings. In this embodiment, a fuel vapor recovery apparatus to be mounted on a vehicle such as an automobile is exemplified. FIG. 1 is a schematic view of the fuel vapor recovery apparatus. For convenience of explanation, the fuel vapor recovery apparatus will be described after explanation of a fuel tank. As shown in FIG. 1, a fuel tank 10 of a vehicle has an inlet pipe 12. A fill opening 13 of the inlet pipe 12 is removably closed with a fuel cap 14. In the fuel tank 10, a fuel pump 16 is located. The fuel pump 16 supplies fuel from the fuel tank to an internal combustion engine 18 (in detail, injector (not shown)). A fuel gauge 20 is provided in the fuel tank 10. The fuel gauge 20 is a float type sensor for detecting liquid level and detects a fuel amount in the fuel tank 10.

A tank inner pressure sensor 22 is located in the fuel tank 10. The tank inner pressure sensor 22 detects tank inner pressure as relative pressure against atmospheric pressure and outputs signals depending on detected value. The signals output from the tank inner pressure sensor 22 are transmitted to an electric control unit (ECU) 24. Here, the tank inner pressure sensor 22 corresponds to a tank inner pressure detector. The ECU 24 corresponds to a regulator.

The fuel tank 10 is provided with a temperature sensor 26. The temperature sensor 26 detects fuel temperature in the fuel tank 10 and outputs signals depending on detected value. The signals output from the temperature sensor 26 are transmitted to the ECU 24. Here, the temperature sensor 26 corresponds to a thermometer and a fuel thermometer. It is believed that the fuel temperature and the fuel vapor temperature in the fuel tank 10 are equal or substantially equal to each other, so that the temperature sensor 26 can be displaced to detect the temperature of fuel vapor in the fuel tank 10. In this case, the temperature sensor corresponds to a thermometer and a vapor thermometer.

Next, a fuel vapor recovery apparatus 30 for treating fuel vapor (vaporized fuel) generated in the fuel tank 10 will be described. The fuel vapor recovery apparatus 30 has a canister 32 capable of adsorbing and desorbing fuel vapor. The canister 32 is connected to the fuel tank 10 (in detail, gaseous layer) via a vapor path 34. In the middle of the vapor path 34, a blocking valve 36 is provided. The ECU 24 controls the blocking valve 36 for opening and closing, i.e., depressurizing control. The valve 36 will be described later in more detail.

The canister 32 is connected to an intake path 40 of the engine 18 via a purge path 38. The intake path 40 is provided with a throttle valve 41 for controlling an amount of intake air to the engine 18. The canister 32 is open to the atmosphere via an atmospheric port 43. The canister 32 is filled with an adsorbent 47 such as activated carbon capable of adsorbing and desorbing fuel vapor. The canister 32 has a purge buffer area 48 near the purge path 38. The purge buffer area 48 is filled with the adsorbent 47 such as activated carbon.

In the middle of the purge pipe 38, a purge valve 45 is provided. The ECU 24 controls the opening and closing of the purge valve 45, i.e., to carry out purge control. The ECU 24 calculates purge amount and opens the purge valve 45 depending on the calculated purge amount. The purge valve 45 is, for example, a motor valve having a driving motor and capable of adjusting the opening amount by controlling the stroke of a valve body. Here, the purge valve 45 can be composed of a solenoid valve having an electromagnetic solenoid which closes without current and opens when current is applied.

Fuel vapor flows from the fuel tank 10 through the vapor pipe 34 into the canister 32, and is adsorbed in the canister 32 (in detail, in the adsorbent 47). While the engine 18 is running, when the ECU 24 opens the purge valve 45 by purge operation, negative pressure in the engine 18 acts on the canister 32 and air (atmospheric air) is introduced into the canister 32 via the atmospheric port 43. Accordingly, fuel vapor desorbed from the canister 32 (in detail, the adsorbent 47) flows through the purge buffer area 48 and purge path 38 into the intake path 40 of the engine 18.

At the bifurcated opening of the vapor path 34 in the fuel tank 10, a cut off valve 50 that opens and closes depending on buoyant force of the fuel and an ORVR valve (onboard refueling vapor recovery valve) 52 that is opened during refueling are provided. The cut off valve 50 is normally opened, and is closed when the vehicle overturns in order to prevent fuel from flowing out of the fuel tank 10 into the vapor path 34. The ORVR valve 52 is a full-fill regulation valve composed of a float valve that is opened when the liquid level in the fuel tank 10 is below full-fill and is closed such that the vapor path 34 is closed when the liquid level rises to the full-fill. When the ORVR valve 52 closes the vapor path 34, the inlet pipe 12 is filled with fuel, and an auto-stop mechanism of a fueling gun or fueling nozzle acts in order to stop refueling.

Figure 2:
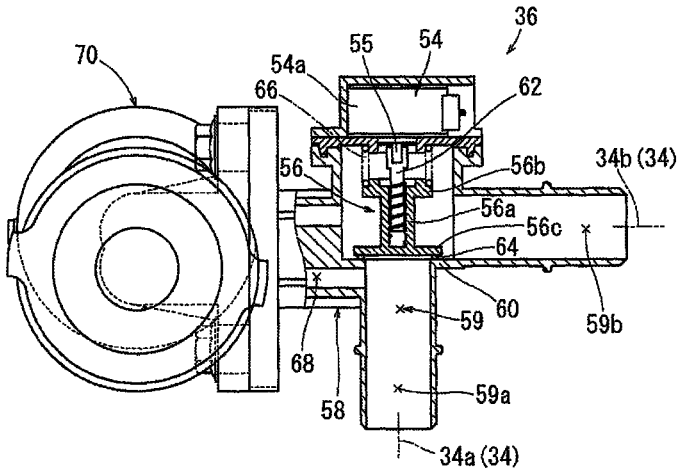
FIG. 2 is a cross-sectional view of a blocking valve.

Next, the blocking valve 36 will be described. The vapor path 34 is divided into a tank side path 34*a* and a canister side path 34*b*. The blocking valve 36 is located between the tank side path 34*a* and the canister side path 34*b*. FIG. 2 is a cross-sectional view of the blocking valve 36. As shown in FIG. 2, the blocking valve 36 is a motor valve that has a stepping motor 54 and can adjust the opening amount by controlling the stroke of a valve body 56. At a valve housing 58 for housing the stepping motor 54 and the valve body 56 therein, a fluid path 59 in a reverse L-shape is formed. The fluid path 59 is divided into a fluid inlet 59*a* communicating with the tank side path 34*a* of the vapor path 34 and a fluid outlet 59*b* communicating with the canister side path 34*b* of the vapor path 34. A valve seat 60 is formed at an opening of the upper end of the fluid inlet 59*a*.

The stepping motor 54 is housed in an upper portion of the valve housing 58. The stepping motor 54 has an output shaft 55 protruding from the motor housing 54*a* and capable of rotating in both directions. The output shaft 55 is directed downwardly in FIG. 2. The output shaft 55 is concentrically connected to a connection shaft 62 in a power transmittable manner. At a lower portion of the connection shaft 62, a male thread is formed. Here, the stepping motor 54 corresponds to a driving motor.

The valve body 56 has a cylindrical portion 56*a* formed in a hollow cylindrical shape with a bottom, and a pair of flanges 56*b* and 56*c* that are formed in a circular plate shape and protrude from an upper end and lower end of the cylindrical portion 56*a*, respectively. At an inner surface of the cylindrical portion 56*a*, a female thread is formed. The valve body 56 is located such that it is movable in an axial direction (vertical direction in FIG. 2) and not movable in a rotational direction. The cylindrical portion 56*a* is preferably engaged with the connection shaft 62. The valve body 56 moves in the axial direction (vertical direction) via the connection shaft 62 in accordance with the rotation of the output shaft 55 of the stepping motor 54. Here, the male portion of the connection shaft 62 and the female portion of the valve body 56 are configured as a feed screw mechanism.

The lower flange (in detail, outer circumference) 56*c* of the valve body 56 is configured as a seal portion 56*c* corresponding to the valve seat 60 of the valve housing 58. At a lower surface of the seal portion 56*c* of the lower flange 56*c* of the valve body 56, a seal member 64 is made from rubber in a ring shape corresponding to the valve seat 60 of the valve housing 58. A valve spring 66 composed of a coil spring is located between the upper flange 56*b* of the valve body 56 and a wall on a motor side of the valve housing 58. The valve spring 66 biases the valve body 56 in a closing direction (lower direction in FIG. 2).

The valve housing 58 has a bypass path 68 for bypassing the opening-closing area of the valve body 56, i.e., surrounding area of the valve seat 60. The valve housing 58 is attached with a 2-way valve 70 that has a positive pressure valve and a negative pressure valve for opening and closing the bypass path 68. When the valve 36 is closed, and tank inner pressure rises to a predetermined pressure, the positive pressure valve is opened such that the tank inner pressure is released toward the canister 32 via the bypass path 68. When the tank inner pressure drops to a predetermined negative pressure, the negative pressure valve is opened such that air (containing vapor) flows from the canister 32 into the fuel tank 10 through the bypass path 68. In this way, deformation of the fuel tank 10 can be prevented.

In the blocking valve 36, the seal portion 56*c* (including seal member 64) of the valve body 56 contacts the valve seat 60 of the valve housing 58 such that it is closed. Under this condition, when the ECU 24 outputs pulse signals for opening to the stepping motor 54 and the number of steps of the stepping motor 54 increases in the opening direction, the output shaft 55 rotates in a valve opening direction, i.e., normal rotation depending on the stepping number. Then, the valve body 56 is moved rearward (upward) by a distance depending on the number of steps by the feed screw mechanism, and thus is opened. When the blocking valve 36 is opened, the ECU 24 is opened and outputs pulse signals for closing to the stepping motor 54 and the number of steps of the stepping motor 54 increases in closing direction, the output shaft 55 rotates in a closing direction, i.e., reverse direction depending on the number of steps. Then, the valve body 56 is moved forward (downward) by a distance depending on the number of steps of the feed screw mechanism. The seal portion 56*c* of the valve body 56 finally contacts the valve seat 60 of the valve housing 58 so that the blocking valve 36 is closed. In this way, the opening amount (lift distance) of the blocking valve 36 is controlled by moving the valve body 56 forward and rearward depending on the drive control of the stepping motor 54.

Next, operation of the fuel vapor recovery apparatus 30 (see FIG. 1) will be explained.

(1) During Parking

During parking, the blocking valve 36 is usually closed. Thus, generation of fuel vapor in the fuel tank 10 is suppressed by keeping the fuel tank 10 in a sealed state.

(2) Before Refueling

In order to refuel, the vehicle is put in park and the blocking valve 36 is completely or substantially completely opened. Thus, the tank inner pressure acts on the canister 32 via the vapor path 34, so that the tank inner pressure can be decreased. Fuel vapor flows from the fuel tank 10 through the vapor path 34 into the canister 32, so that the fuel vapor is adsorbed in the canister 32. As a result, the tank inner pressure decreases to match or substantially match the atmospheric pressure. When the valve 36 is open and power distribution is turned off, the detent torque of the stepping motor 54, lead angle of the feed screw mechanism and the like remain in an open valve state. Therefore, it is able to reduce electric power required to remain in an open valve state as compared with a solenoid valve.

Then, the operator opens the fuel cap 14. Due to the fact that the tank inner pressure decreases to near atmospheric pressure by this time, vapor leak into the atmosphere from the fill opening 13 can be prevented when the fuel cap 14 is removed.

(3) During Fueling

The ECU 24 remains as the blocking valve 36 in an open state. In this state, the operator fills the fuel tank 10. During fueling, fuel vapor flows from the fuel tank 10 through the vapor path 34 and is trapped in the canister 32. In this way, ORVR function (vapor recovery function during fueling) is carried out. After fueling, the operator closes the fill opening 13 with the fuel cap 14. Finally, the ECU 24 completely closes the blocking valve 36.

(4) During Driving the Engine 18

During driving the engine 18, the blocking valve 36 is basically closed in a similar way as it is during parking. When the engine 18 is running, and predetermined purge requirements are met, purge control (opening and closing control of the purge valve 45) for purging fuel vapor trapped in the canister 32 is carried out. Thus, due to negative pressure in the engine 18, fuel vapor is introduced, i.e., purged, into the intake path 40 from the canister 32 together with air flowing into the canister 32 from the atmospheric port 43. During a purge operation, the ECU 24 opens the blocking valve 36 at a predetermined opening amount for depressurizing the fuel tank 10 in order to maintain the tank inner pressure at atmospheric pressure or substantially atmospheric pressure.

Figure 3:
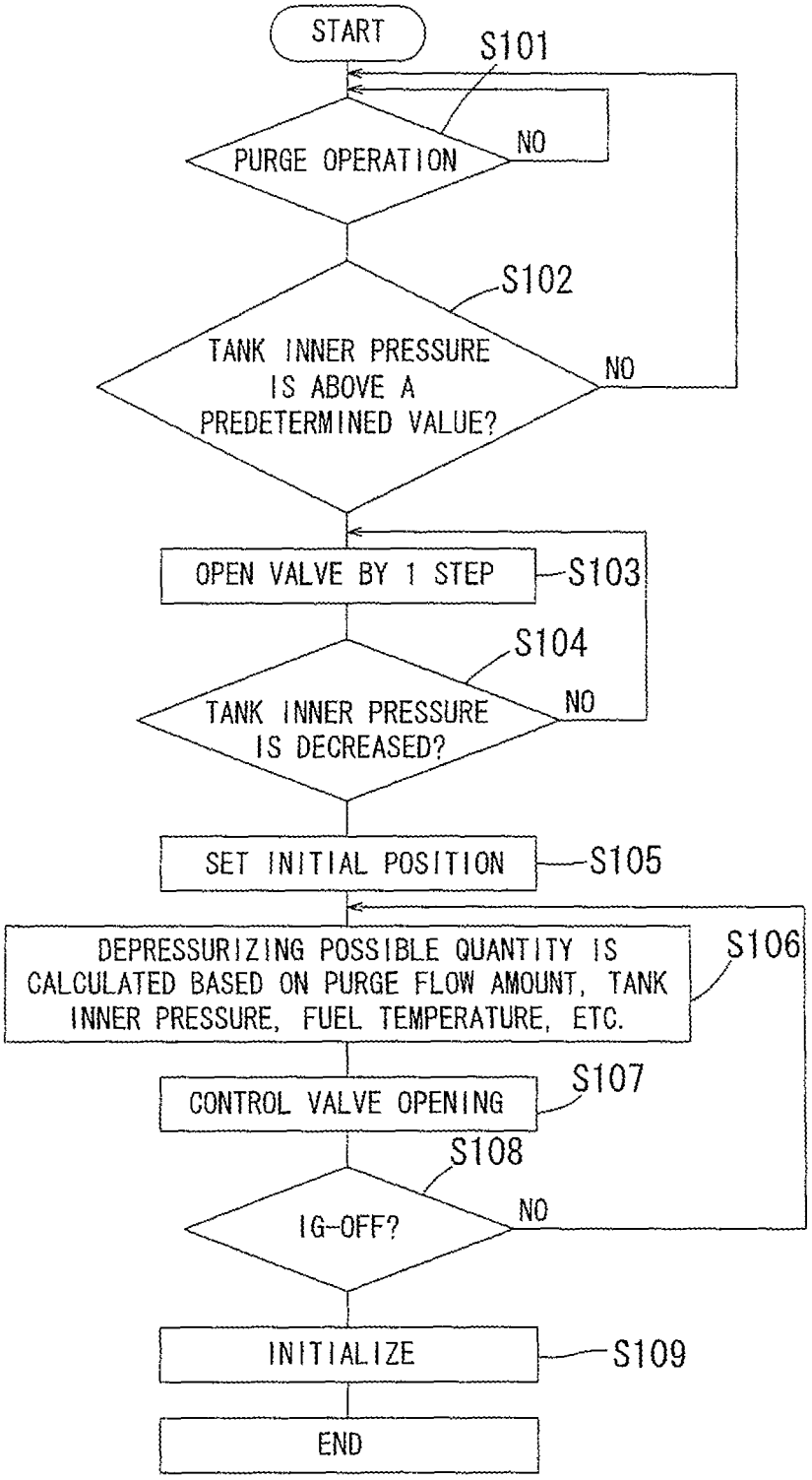
FIG. 3 is a flowchart showing the processing routine of a depressurizing fuel tank.

Next, steps for depressurizing the fuel tank during purge operation will be described. FIG. 3 is a flowchart showing the processing routine for depressurizing the fuel tank. The processing routine for depressurizing the fuel tank is carried out by the ECU 24 when the engine is started, i.e., when IG (ignition) is ON. As shown in FIG. 3, in steps S101 and S102, it is determined whether depressurizing requirements are met or not. That is, in S101, it is determined whether purge operation is carried out. When the purge is carried out, it is determined whether the tank inner pressure that is detected by the tank inner pressure sensor 22 is above a predetermined value in step S102. When the tank inner pressure is above the predetermined value, it is determined to meet requirements for depressurizing, and processing from S103 for depressurizing the fuel tank 10 is carried out. On the other hand, when such results in steps S101 and S102 are not fulfilled, it is determined that the requirement for depressurizing is not met, and returns to the step S101.

Next, the stepping motor 54 of the blocking valve 36 is opened by one step distance in step S103. Next, it is determined whether or not the tank inner pressure detected by the tank inner pressure sensor 22 decreases in step S104. When the tank inner pressure does not decrease, it is determined that the seal member 64 of the valve body 56 does not move away from the valve seat 60 and returns to step S103. Then, the stepping motor 54 is opened by one step distance again, and then it is determined whether or not the tank inner pressure decreases in step S104. When the tank inner pressure does not decrease in step S104, it returns to step S103 again.

When the tank inner pressure decreases in step S104, it is determined that the seal member 64 of the valve body 56 is moved away from the valve seat 60. At this time, the decreasing start point of the tank inner pressure is set as initial point for the basis of the opening amount of the valve body 56 of the blocking valve 36 in step S105. That is, the starting point of decreasing the tank inner pressure is stored as the valve opening starting point. Due to the compressed amount in the seal member 64 of the valve body 56 before opening, the number of steps of the stepping motor 54 required from action of the opening valve of the stepping motor 54 to the actual opening valve of the valve body (including seal member 64) varies. Thus, if the starting point of opening movement of the stepping motor 54 is set as the initial point, there is error between flow amount depending on the opening amount of the valve body 56 and actual flow amount. Because of this, it is difficult to precisely control the opening amount of the blocking valve 36. On the other hand, when the decreasing start point of the tank inner pressure is set as initial point of the valve body 56 of the blocking valve 36, the error between the flow amount depending on the opening amount of the valve body 56 and the actual flow amount can be eliminated or reduced. In this way, the opening amount blocking valve 36 can be precisely controlled.

Next, in step S106, the possible amount that can be depressurized (depressurizing flow amount) is calculated in accordance with a purge flow amount, tank inner pressure, fuel temperature, etc. When the opening amount of the purge valve 45 is the same, the purge flow amount is different depending on intake path negative pressure (intake negative pressure). The depressurizing amount is also different as it depends on the fuel temperature, the fuel amount, etc. Here, the depressurizing flow amount suitable for the purge flow amount is calculated from intake path negative pressure and the opening amount of the purge valve 45. The opening amount of the purge valve is determined by calculation or a control graph. In this way, the opening amount of the blocking valve 36 can be determined.

Figure 4:
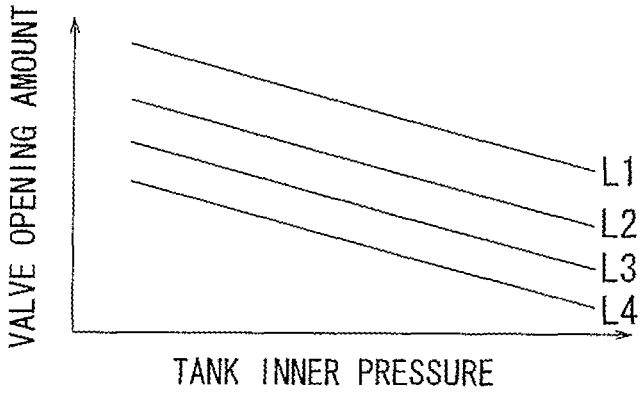
FIG. 4 is a diagram showing the relationship between tank inner pressure and the blocking valve.

FIG. 4 is a graph showing the relationship between the tank inner pressure and the opening amount of the blocking valve 36. In FIG. 4, a characteristic line L1 is a situation where the purge flow amount is large, while characteristic lines L2, L3 and L4 show smaller cases of the purge flow amount. The opening amount of the blocking valve 36 corresponding to the depressurizing flow amount is calculated based on the current purge flow amount. And, in FIG. 4, the opening amount of the blocking valve 36 is adjusted based on the tank inner pressure detected by the tank inner pressure sensor 22. That is, as the tank inner pressure increases, the opening amount decreases. This means that when the blocking valve 36 is opened at a higher tank inner pressure, the flow rate of the depressurizing becomes higher, and the depressurizing flow amount per unit time becomes larger. When the depressurizing amount becomes larger, air-fuel ratio of the engine 18 varies drastically. As shown in FIG. 4, in order to prevent drastic variation of the air-fuel ratio, the opening amount decreases when the tank inner pressure increases. Here, the graph showing relationship between the tank inner pressure and the opening amount is made by preliminary examination, calculation and the like. The graph is stored in a ROM of the ECU 24.

Figure 5:
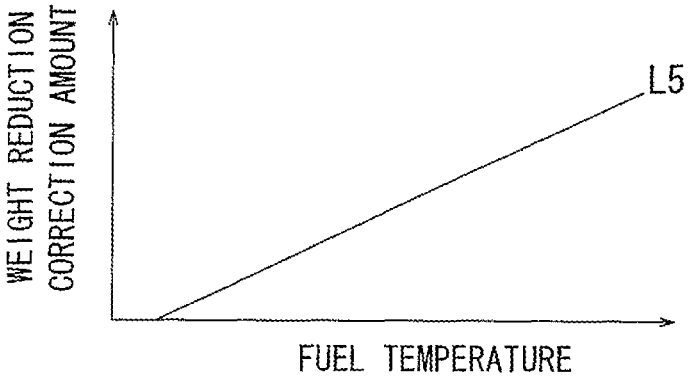
FIG. 5 is a diagram showing the relationship between fuel temperature and weight reduction correction amount of the blocking valve.

FIG. 5 is a graph showing the relationship between fuel temperature and the weight reduction correction amount. A characteristic line L5 in FIG. 5 is set to decrease the opening amount of the blocking valve 36 depending on fuel temperature detected by the temperature sensor 26. That is, when the fuel temperature is higher, it is corrected such that the valve opening amount is decreased. This means that when the blocking valve 36 is opened at a higher fuel temperature, flow rate of the depressurizing becomes higher, and the flow amount of the depressurizing per unit time becomes larger. When the depressurizing amount becomes larger, air-fuel ratio of the engine 18 varies drastically. Thus, as shown in FIG. 5, in order to prevent drastic variation of the air-fuel ratio, the weight reduction correction amount increases when the fuel temperature is higher. Therefore, when the weight reduction correction amount is larger, the opening amount of the blocking valve 36 becomes smaller. Here, the graph showing the relationship between the fuel temperature and the weight reduction correction amount is made according to preliminary examination, calculation and the like. The graph is stored in the ROM of the ECU 24.

Next, in step S107, the blocking valve 36 is driven depending on the opening valve amount that corresponds to depressurizing possible quantity calculated in step S106. Then, in step S108, it is determined whether IG is off or not. When the IG is not off, it returns to the step S106 and the steps S106 and S107 are carried out. Due to this driving control of the blocking valve 36 in step S107, continuous and small amount of depressurizing can be carried out.

When the IG is off in step S108, initialization is carried out in step S109. That is, the ECU 24 has a timer, and is applied with current after the IG is off. In this state, the ECU 24 completely closes the blocking valve 36 and the purge valve 45 is turned off. The stepping motor 54 of the blocking valve 36 is driven toward a closing position from the initial position by some steps corresponding to a predetermined compressed amount of the seal member 64.

When the IG is off, the engine 18 is stopped, and purge control of the purge valve 45 is stopped. Here, purge control of the purge valve 45 during driving the engine 18 is temporarily stopped when the requirements are not met, however the purge control does not actually finish until the IG is off. In addition, with respect to valve opening control of the blocking valve 36, when the requirements are not met, i.e., purge flow rate is above a predetermined value and a tank inner pressure is above a predetermined value, it is processed such that depressurizing possible quantity is zero (that is, the blocking valve 36 is not opened). When the tank inner pressure is above the predetermined value and the purge flow rate is above the predetermined value due to variation of fuel temperature or the like, the opening valve control is restarted again. Thus, until the IG is off, the opening valve control of the blocking valve 36 continues.

In accordance with the fuel vapor recovery apparatus 30, the blocking valve 36 is a motor valve that has the stepping motor 54 and can adjust the opening amount by controlling the stroke of the valve body 56. Thus, it is different from a solenoid valve, and the small amount of depressurizing of the fuel tank 10 can be continuously carried out during purge. Therefore, influence on the air-fuel ratio of the engine 18 can be decreased.

Figure 6:
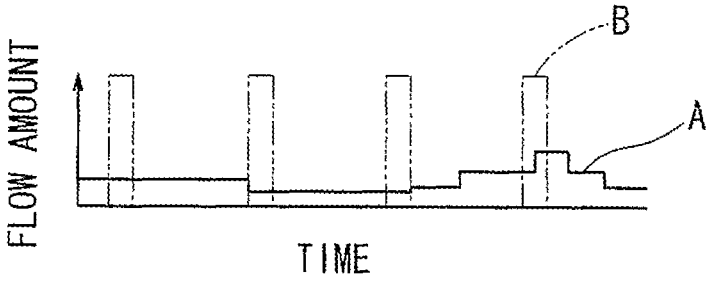
FIG. 6 is a characteristic line diagram showing the relationship between depressurizing time and flow amount.

This point will be described further. FIG. 6 shows characteristic lines showing the relationship between depressurizing time and flow amount. In FIG. 6, characteristic line A shows characteristic of the blocking valve (motor valve) 36 of this disclosure, and characteristic line B shows the characteristic of a common solenoid valve. According to characteristic line B, depressurizing is intermittently carried out and the large amount of fluid flows out every opening, so that influence on the air-fuel ratio of the engine 18 is large. On the other hand, in accordance with characteristic line A, a small amount of depressurizing is continuously carried out, so that depressurizing can be steadily carried out. Thus, influence on the air-fuel ratio of the engine 18 can be decreased. In addition, the depressurizing flow rate can be equalized so that instantaneous flow rate (see characteristic line B) can be decreased.

During refueling, it can be configured to allow a large amount of gas to flow through the vapor path 34 by increasing the opening amount of the blocking valve 36 (motor valve). When the valve is composed of a solenoid valve, pressure loss of flow path at the valve is determined by design. However, when the blocking valve 36 is composed of a motor valve, pressure loss of the flow path at the valve can be decreased by increasing the opening amount of the valve during refueling. Thus, in a vehicle where pressure loss of a system relating to fueling is large, balance of pressure loss for smooth fueling can be carried out by decreasing the pressure loss at the flow path of the valve portion of the blocking valve 36. Therefore, it is not necessary to balance pressure loss by tuning of other products.

During refueling, even if power distribution to the blocking valve 36 is off, the valve opening state is maintained by detent torque of the stepping motor 54, lead angle of the feed screw mechanism, etc. Thus, it is different from the situation where a solenoid valve is used in that it is able to decrease power required to keep the valve in an opened state. It is also different from the solenoid valve in that it is able to decrease operating noise such as impact noise or pulse sound when opening and closing the blocking valve 36. Accordingly, a floating mechanism or an air damper against operation noise is not required.

The ECU 24 sets an initial position as the basis of the opening amount of the valve body for every initial opening of the blocking valve 36 after running the engine 18. Therefore, the opening amount of the blocking valve 36 can be controlled precisely.

The ECU 24 sets the decreasing start point of the tank inner pressure detected by the tank inner pressure 22 as an initial position of the valve body 56 when opening the blocking valve 36. Thus, regardless of the compressed degree of the seal member 64 that is compressed between the valve body 56 and the valve seat 60 when the blocking valve 36 is closed, it is able to set the decreasing start point of the tank inner pressure as the initial point of the valve body 56. Thus, the error between the flow amount due to the opening amount of the valve body 56 and the actual flow amount can be eliminated or decreased. In this way, the opening amount of the blocking valve 36 can precisely controlled.

The ECU 24 controls the opening amount of the blocking valve 36 in accordance with purge flow rate. Thus, by determining the depressurizing flow rate in accordance with the purge flow rate, influence on the air-fuel ratio of the engine 18 can be decreased.

The ECU 24 corrects the opening amount of the valve 36 based on the tank inner pressure detected by the tank inner pressure sensor 22. Thus, influence on the air-fuel ratio of the engine 18 can be decreased by correcting the depressurizing flow rate in accordance with the tank inner pressure.

The ECU 24 corrects, more specifically, decreases the opening amount of the valve 36 depending on the fuel temperature detected by the temperature sensor 26. Thus, influence on the air-fuel ratio of the engine 18 can be decreased by correcting the depressurizing flow rate in accordance with the fuel temperature.

The ECU 24 can be configured to correct the opening amount of the valve 36 in accordance with the air-fuel ratio detected by an air-fuel ratio sensor 19. The air-fuel ratio sensor 19 is provided on an exhaust path of the engine 18, for detecting air-fuel ratio in exhaust gas and outputting signals to the ECU 24 in accordance with the detected value. The ECU 24 is configured to correct the opening amount of the valve 36 in accordance with the air-fuel ratio detected by the air-fuel ratio sensor 19. Thus, when the air-fuel ratio is on the low side, the ECU 24 increases the opening amount. And, when the air-fuel ratio is on the high side, the ECU 24 decreases the opening amount. In this way, the influence on the air-fuel ratio of the engine 18 can be decreased. Here, the air-fuel ratio sensor 19 corresponds to air-fuel ratio detector.

The present invention is not limited to the embodiment and can be modified without departing from the scope of the invention. For example, a driving motor of the blocking valve 36 can be composed of a DC motor instead of the stepping motor 54. Further, as previously discussed, movement of the stepping motor 54 during detection of opening of the valve 36 is set as one step. In other embodiments, however, the pattern and the number of steps in opening and closing directions can be varied.

The invention claimed is:

1. A fuel vapor recovery apparatus to be mounted on a vehicle having an internal combustion engine and a fuel tank, the fuel vapor recovery apparatus comprising:

a pressure detector configured to detect an inner pressure of the fuel tank;

an adsorbent canister capable of adsorbing and desorbing fuel vapor vaporized in the fuel tank;

a vapor path providing communication between the fuel tank and the adsorbent canister;

a purge path providing communication between the adsorbent canister and an intake path of the internal combustion engine;

a purge valve configured to open and close the purge path;

a blocking valve configured to open and close the vapor path and having a valve body; and a regulator for controlling the purge valve and the blocking valve, wherein the regulator is configured to receive a pressure reading from the pressure detector;

wherein the fuel tank is sealed when the blocking valve is closed;

wherein the fuel tank is configured to be depressurized by opening the blocking valve;

wherein the blocking valve comprises a motor valve that has a driving motor and wherein the regulator is configured to adjust an opening amount of the blocking valve by controlling the driving motor to adjust a stroke of the valve body; and wherein the regulator is configured to store a position of the valve body when an initial decrease in the inner pressure of the fuel tank is detected by the pressure detector as a valve opening start position each time the internal combustion engine is started and to base subsequent adjustment of the opening amount of the blocking valve on the valve opening start position.

2. The fuel vapor recovery apparatus according to claim 1, wherein the regulator is configured to adjust the opening amount of the blocking valve based on a purge flow amount after storing the valve opening start position.

3. The fuel vapor recovery apparatus according to claim 2, wherein the regulator is configured to adjust the opening amount of the blocking valve depending on the inner pressure of the fuel tank detected by the pressure detector after storing the valve opening start position.

4. The fuel vapor recovery apparatus according to claim 2, further comprising:

an air-fuel ratio detector configured to detect an air-fuel ratio in an exhaust gas of the internal combustion engine;

wherein the regulator is configured to adjust the opening amount of the blocking valve depending on the air-fuel ratio detected by the air-fuel ratio detector after storing the valve opening start position.

5. The fuel vapor recovery apparatus according to claim 2, further comprising:

a thermometer configured to detect a temperature of fuel or vapor in the fuel tank, wherein the regulator is configured to adjust the opening amount of the blocking valve based on the temperature of fuel or vapor detected by the thermometer after storing the valve opening start position.

6. A fuel vapor recovery apparatus to be mounted on a vehicle having an internal combustion engine and a fuel tank, the fuel vapor recovery apparatus comprising:

a pressure detector configured to detect an inner pressure of the fuel tank;

an adsorbent canister capable of adsorbing and desorbing fuel vapor vaporized in the fuel tank;

a vapor path providing communication between the fuel tank and the adsorbent canister;

a purge path providing communication between the adsorbent canister and an intake path of the internal combustion engine;

a purge valve configured to open and close the purge path;

a blocking valve configured to open and close the vapor path and having a valve body; and a regulator for controlling the purge valve and the blocking valve, wherein the regulator is configured to receive a pressure reading from the pressure detector;

wherein the fuel tank is sealed when the blocking valve is closed;

wherein the fuel tank is configured to be depressurized by opening the blocking valve;

wherein the blocking valve comprises a motor valve that has a driving motor and wherein the regulator is configured to adjust an opening amount of the blocking valve by controlling the driving motor to adjust a stroke of the valve body; and wherein the regulator is configured to:

move the valve body in a valve opening direction to purge the adsorbent canister when the inner pressure of the fuel tank is above a predetermined value; and store a position of the valve body as a valve opening start position when the pressure detector detects a decrease in the inner pressure of the fuel tank as the valve body moves in the valve opening direction.

7. The fuel vapor recovery apparatus according to claim 6, wherein the regulator is configured to calculate a depressurization possible quantity after storing the valve opening start position, and to adjust the opening amount of the blocking valve based on the depressurizing possible quantity.

* * * * *